US005088603A

United States Patent [19]

Kirkpatrick

[11] Patent Number: 5,088,603

[45] Date of Patent: Feb. 18, 1992

[54] TEAR-OPENING CAPLET BLISTER FOIL PACKAGE

[75] Inventor: Jack H. Kirkpatrick, Haverford, Pa.

[73] Assignee: Sharp Packaging, Conshohocken, Pa.

[21] Appl. No.: 544,023

[22] Filed: Jun. 26, 1990

Related U.S. Application Data

[63] Continuation of Ser. No. 41,656, Apr. 21, 1987, abandoned, which is a continuation of Ser. No. 898,219, Aug. 20, 1986, abandoned, which is a continuation of Ser. No. 633,145, Jul. 23, 1984, abandoned.

[51] Int. Cl.[5] ..... B65D 83/04; A61J 1/03

[52] U.S. Cl. ..... 206/530; 206/461; 206/470; 206/434; 206/532

[58] Field of Search ..... 206/461–471, 206/484, 528, 530, 532, 534.2, 604, 608, 611, 612, 620, 626, 634

[56] References Cited

U.S. PATENT DOCUMENTS

| | | | |
|---|---|---|---|
| 2,069,333 | 2/1937 | Salfisberg | 206/56 |
| 2,248,266 | 7/1941 | Abrams | 206/484 |
| 2,358,246 | 9/1944 | Nicolle | 206/56 |
| 2,530,127 | 11/1950 | Kubik | 206/56 |
| 2,658,613 | 11/1953 | Volckening | 206/484 |
| 2,760,630 | 8/1956 | Lakso | 206/56 |
| 2,796,982 | 6/1957 | Volckening | 206/46 |
| 2,834,456 | 5/1958 | Langer | 206/42 |
| 2,895,606 | 7/1959 | Hoag | 206/56 |
| 2,968,391 | 1/1961 | Sparks | 206/42 |
| 3,276,573 | 10/1966 | Kaufman et al. | 206/42 |
| 3,276,669 | 10/1966 | Vilutis | 229/51 |
| 3,301,395 | 1/1967 | Swezay | 206/484 |
| 3,324,995 | 6/1967 | Sharp, Jr. | 206/42 |
| 3,327,843 | 6/1967 | O'Meara et al. | 206/42 |
| 3,331,495 | 7/1967 | Leckzik et al. | 206/42 |
| 3,380,518 | 4/1968 | Canteloube et al. | 165/171 |
| 3,387,699 | 6/1968 | Heller | 206/42 |
| 3,429,426 | 2/1969 | Wolf et al. | 206/42 |
| 3,456,784 | 7/1969 | Sirago | 206/78 |
| 3,472,367 | 10/1969 | Hellstrom | 206/56 |
| 3,494,322 | 2/1970 | Dubbels | 116/121 |
| 3,504,788 | 4/1970 | Gray | 206/42 |
| 3,603,453 | 9/1971 | Serrell et al. | 206/47 R |
| 3,625,351 | 12/1971 | Eisenberg | 206/484 |
| 3,650,461 | 3/1972 | Hutcheson | 229/66 |
| 3,689,458 | 9/1972 | Hellstrom | 206/56 AA |
| 3,759,371 | 9/1973 | Marks | 206/42 |
| 3,809,220 | 5/1974 | Arcudi | 206/484 |
| 3,809,221 | 5/1974 | Compere | 206/461 |
| 3,899,080 | 8/1975 | Brunda | 206/531 |
| 3,921,805 | 11/1975 | Compere | 206/532 |
| 3,924,746 | 12/1975 | Haines | 206/530 |
| 4,091,930 | 5/1978 | Buchner et al. | 206/605 |
| 4,196,809 | 4/1980 | Tonrey | 206/534 |
| 4,398,635 | 8/1983 | Hirt | 206/532 |

FOREIGN PATENT DOCUMENTS 577151 5/1946 United Kingdom .

*Primary Examiner*—Stephen Marcus

*Attorney, Agent, or Firm*—Woodcock Washburn Kurtz Mackiewicz & Norris

[57] ABSTRACT

A novel child resistant blister foil package for use with oblong medicaments, such as caplets, is disclosed comprising a base layer and a rigid, substantially rectangular blister layer composed of low-extensible film joined to the base layer. The blister layer of this package has an oblong, longitudinally oriented blister formed on one end thereof and a longitudinally directed tear slit disposed through the opposing edge thereof. Tear tabs are thus provided between the blister and the slitted edge which permit the package to be torn open through the entire length of the oblong blister. The preferred package exhibits a tear propagation resistance, in accordance with ASTM method D1938, which, unlike flexible pouch packages, is substantially continuous during the opening of the package.

13 Claims, 4 Drawing Sheets

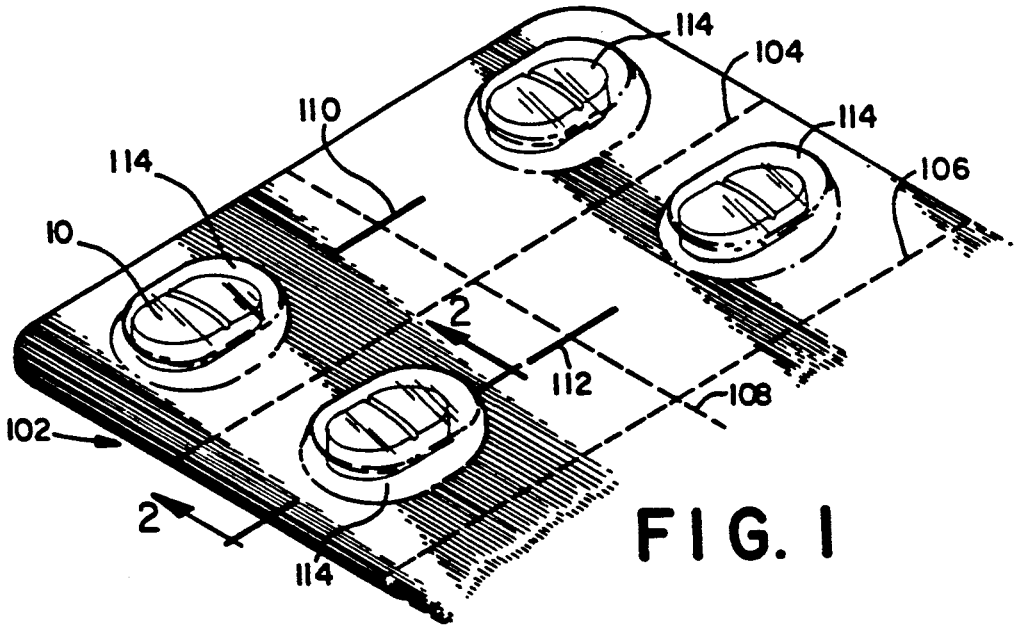
FIG. 1
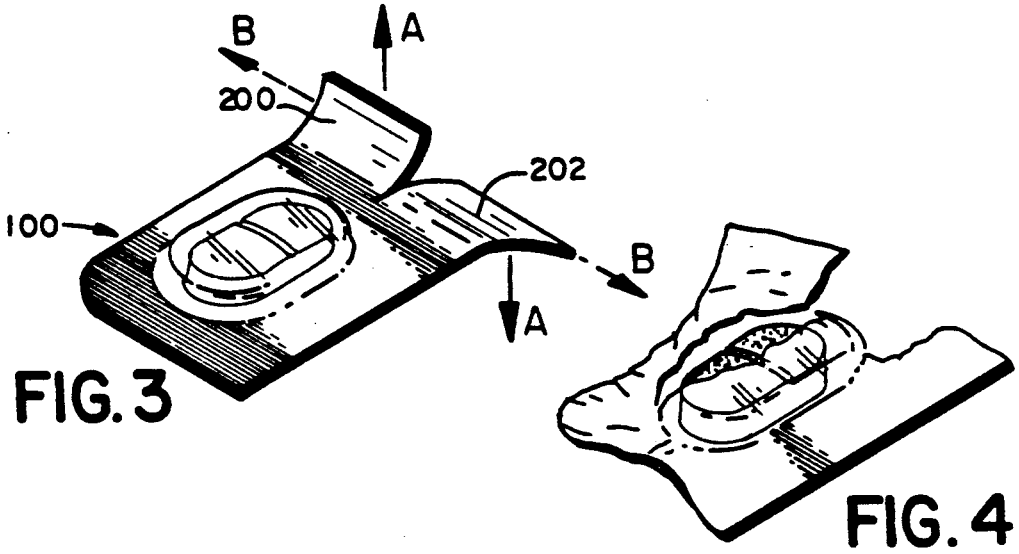
FIG. 3
FIG. 4
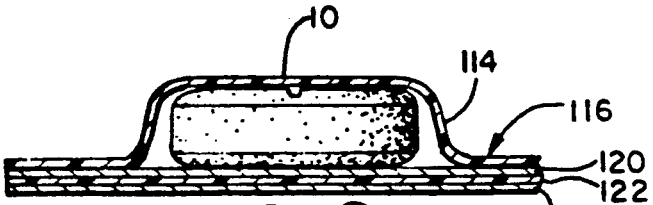
FIG. 2

TEAR-OPENING CAPLET BLISTER FOIL PACKAGE

This is a continuation of application Ser. No. 041,656, filed Apr. 21, 1987, now abandoned.

This is a continuation of application Ser. No. 898,219, filed Aug. 20, 1986, now abandoned which in turn is a continuation of application Ser. No. 633, 145, filed July 23, 1984, now abandoned.

BACKGROUND OF THE INVENTION

The present invention relates to the field of disposable medicament packages, and more particularly to field of child resistant packages for individual, relatively small oblong medicaments, such as capsules or caplets.

In the past several years, great attention has been directed towards the provision of medicament packaging which is not only child-resistant, but which also provides clear visual evidence of tampering. The provision of suitable child-resistant, tamper-resistant packages is complicated somewhat by the fact that many medicaments are intended for use by elderly, arthritic or infirm users who may not possess the dexterity or strength which is required to readily access the medicaments in tamper or child resistant packages.

Over the years, a wide variety of disposable plastic packages have been suggested which are accessible through a variety of folding, stripping, rupturing, peeling and/or tearing procedures. These packages have typically been formed of transparent top layers which are sealed or otherwise bonded to backing layers in a manner which provides a cavity, pouch or "blister" in which the medicament is disposed. The top and backing layers may be formed of flexible packaging materials, rigid thermoformable plastic materials, foil, paper, or laminates, or combinations thereof. Medicament cavities formed between such layers may be accessed by tearing into them from an edge of the package, which tearing may or may not be facilitated through the provision of a starting notch or slit. Alternatively, these cavities may be accessed by stripping a backing layer from the package to expose the cavity, or to expose a push-through underlayer. These and other access methods may require additional folding, tearing, or stripping to gain medicament access. Furthermore, the packages may be provided individually, or as part of a strip, matrix or array of packages joined by tear-apart perforations.

Tear-open packages of the above described types generally exhibit centered medicament cavities having uniform sealed marginal regions around the peripheries thereof. When the medicament is a pill, these cavities generally comprise generally circular pouches, such as those illustrated in U.S. Pat. Nos. 2,069,333 (Salfisberg); 2,796,9S2 (Volckening); 2,35S,246 (Nicolle) or 3,809,220 (Arcudi); or circular blisters such as U.S. Pat. Nos. 3,456,784 (Sarago) or 4,398,635 (Hirt). Generally rectangular pouches, such as those shown in U.S. Pat. Nos. 3,650,461 (Hutchenson) or 3,276,669 (Vilutis); and substantially square thermoformed cavities such as that shown in U.S. Pat. Nos. 4,091,930 (Buchner et al) are also known. When the medicament is a powder or liquid, other cavity configurations, such as the generally triangular pouch of U.S. Pat. No. 2,103,389 (Salfisberg) or the pleated pouch of U.S. Pat. No. 2,895,606 (Hoag) are also known. See also British specification 577,151 (McGeorge).

Notwithstanding the disclosures of the above-identified patents, tear-opening packages have lost favor in certain applications to blister packages which do not require tearing in order to gain package access. Such packages include stripable, rupturable and/or "peel and push" packages. In stripable packages one or more layers of a multilayer backing laminate must be peeled away from the underside of a blister before the pill or other medicament may be accessed. For examples of stripable packages, see U.S. Pat. Nos. 3,603,453; 3,380,518; 2,834,456; 2,760,630; and 2,530,127. In rupturable packages the pill is generally pushed through a layer of the backing to provide medicament access. See for example, U.S. Pat. Nos. 3,759,371; 3,689,458; 3,494,322; 3,472,367; 3,387,699; 3,331,495; 3,324,995 and 3,276,573. In U.S. Pat. Nos. 3,809,221; 3,899,080; 3,327,843; 3,504,788; 3,429,426 and 2,968,391, and in Reissue 29,705, a combination of opening operations are required. See also U.S. Pat. No. 4,196,809. While packages requiring peeling, folding, stripping, and/or rupturing operations have achieved considerable success in the field, many users do not have the requisite fine motor coordination to easily gain access to such packages. Furthermore, the filling and sealing of such packages may require great care to ensure that the backing materials are sufficiently sealed to the blister layer as to afford substantial child and/or tamper resistance without oversealing those layers to effectively preclude the intended stripping away of one of those layers by the end user.

Many of the above-described packaging problems are aggravated as the size of the medicament to be packaged decreases. Nonetheless, from the standpoint of ease of swallowing, smaller medicaments are generally preferred. Such medicaments include recently developed "caplets" which are oblong tablets of a size equal to or slightly smaller than conventional capsules. In packaging such small medicaments it is not enough to simply consider the characteristics of the package during the initial stages of opening. One must also consider the configuration of the package during the final stages of opening and in its completely opened form, to determine whether the medicament will be retained in or "thrown" from the package, and, if retained, whether it will be sufficiently accessible to permit an arthritic or infirm user to gain reasonable access thereto. Accordingly, while many foldable, stripable, rupturable, and/or tearable packages have been suggested, there remains a need for a low-cost child-resistant, tamper-resistant, blister package for use with relatively small, oblong medicaments, such as caplets.

SUMMARY OF THE INVENTION

The present invention provides a novel blister foil package for use with relatively small oblong medicaments, such as caplets. This package comprises a base layer and a rigid, substantially rectangular blister layer having an offset, oblong longitudinally oriented blister formed at one thereof. A tear slit oriented towards the end of the oblong blister is disposed through the opposite end of the package. Tear tabs are thus provided on either side of the tear slit which allow the package to be easily grasped to create a tear which will extend through the entire length of one side of the blister. Due to the tearing characteristics of such a longitudinally oriented blister, the therein contained caplet will normally be retained within an undisturbed blister portion, but yet be readily accessible even to an infirm or arthritic user.

The preferred embodiment blister foil package of the present invention comprises a rigid blister layer which is composed of a low-extensible film which exhibits a tear propagation resistance (in accordance with ASTM method D1938) which is substantially continuous during the opening of the package. The tear propagation resistance of the packaging materials used in this package is important due to the fact that successful opening of the package requires creation of a tear through substantially the entire length of the rectangular package except for a single sealed marginal edge of the package adjacent to the proximate end of the blister. The use of such a low-extensible film, such as an unplasticized rigid PVC film, permits the package of the present invention to exhibit a higher initial tear propagation resistance than comparable flexible pouch packages while exhibiting a lower final tear propagation resistance than would otherwise be encountered using a film of high extensibility. Accordingly, the package of the present invention exhibits a tear propagation resistance of at least about one and no more than about two pounds per inch during the entire tearing process.

Accordingly, a primary object of the present invention is the provision of a low cost child-resistant, tamper-resistant package for use in packaging relatively small, oblong medicaments, such as caplets.

A further object of the present invention is the provision of a tear-opening, blister-foil package which is relatively easily opened by elderly, arthritic, or infirm and users.

A further object of the present invention is the provision of a tear-opening, blister-foil package for relatively small, oblong medicaments, which package provides ready access to the packaged medicaments after opening by retaining those medicaments within a portion of the blister after tearing.

These and further objects of the present invention will become apparent from the following more detailed description.

BRIEF DESCRIPTION OF THE DRAWINGS

FIG. 1 is a foreshortened isometric view of an array of the preferred blister-foil packages of the present invention;

FIG. 2 is a cross-section of one of the preferred embodiment blister-foil packages of FIG. 1, taken as indicated by the lines and arrows 2—2 of FIG. 1;

FIG. 3 is an isometric view of one of the blister-foil packages of FIG. 1, showing the disposition of the tear tabs of the package during the initial stages of the tear-opening operation;

FIG. 4 is an isometric view of the package of FIG. 3 following completion of the tear-opening operation, and further showing the accessible retention of a caplet in a portion of the torn blister thereof;

DESCRIPTION OF THE PREFERRED EMBODIMENTS

Figure 5:
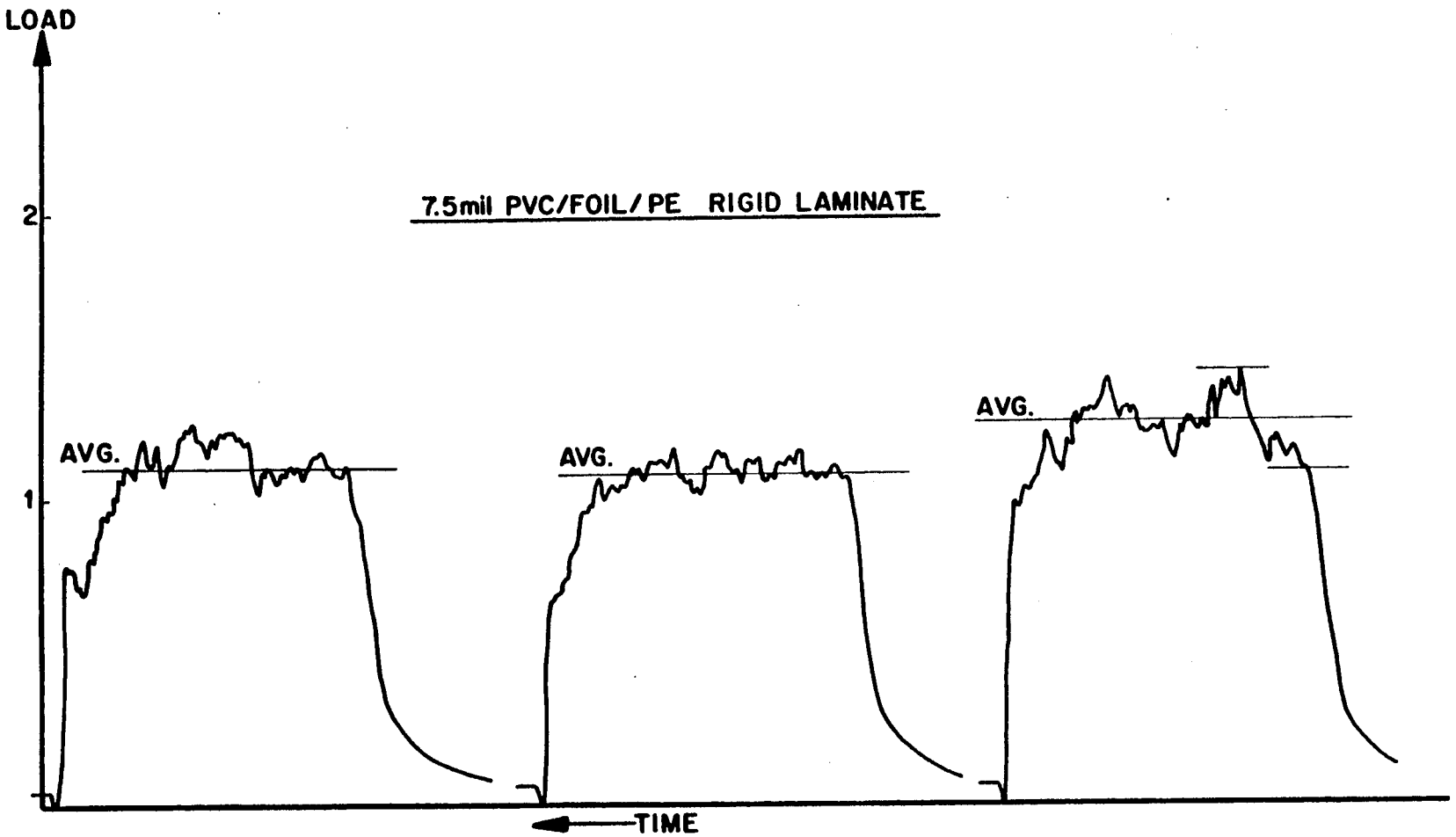
FIG. 5 is a graph of load versus time of a tear propagation test conducted on a preferred 7.5 mill 0.200 mm) PVC/foil/PE laminate useful for making preferred embodiment packages of the present invention.

The present invention provides a novel child resistant blister-foil package for use with relatively small, oblong medicaments, such as caplets. As used herein, the term "relatively small medicaments" refers to those having lengths of less than one half inch (1.3 centimeter). Such medicaments are considered "oblong" if they are at least twice as long as they are wide. Caplets are typically small pills which are about ⅜" to 7/16" (0.9–1.1 cm) long and about 3/16" to ¼" (0.5–0.6 cm) wide. Such caplets 10 are illustrated in FIGS. 1–4.

Referring now to the figures, the preferred embodiment blister-foil package, designated generally 100, is normally supplied to the user in the form of an array 102 of such packages which are separable from each other by perforations 104, 106, and 108. As seen in the figures, each blister package is generally rectangular in shape. As used herein, the term "rectangular" means that the blister package has a length which is at least 25% longer, and preferably at least 35% longer, than its width. For the caplets described above and illustrated in the figures, the preferred package length is about one inch (2.5 cm) and its preferred width is between ½" ¾" (1.3–1.9 cm), preferably less than 11/16" (1.75 cm) and even more preferably about 9/16" (1.4 cm).

Each package comprises a rigid, substantially rectangular blister layer, designated generally 116 in FIG. 2, which blister layer has defined therein an oblong, longitudinally oriented blister 114. As seen in the figures, the axis of the oblong blister is disposed generally along the center line of the longitudinal axis of the rectangular package, but is substantially offset towards one end of the rectangle, which is hereinafter referred to as the "blister end" or "blister edge" of the package. The edge of the rectangle which is remote from the blister (hereinafter the "tear slit end" or "tear slit edge") is provided with a tear slit, such as tear slits 110 and 112. In the preferred embodiment, the distance from the nearest end of the blister to the tear slit edge is about twice that from the blister edge to its nearest end of the blister. For example, for the packages illustrated in FIG. 1, the distance between the closest ends of blisters 114 and perforation 108 is about ⅜" (0.95 cm), whereas the other ends of those blisters are disposed approximately 3/16" (0.47 cm) from their associated blister edges.

Tear slits 110 and 112 are straight slits which are oriented to bisect the longitudinal axis of each oblong blister. These tear slits preferably extend across the face of each blister package by less than one third of the distance, preferably about 20% of the distance, between the tear slit end of the blister and the tear slit edge of the package.

The preferred embodiment package also comprises a laminated base layer which is joined to the blister layer, preferably by heat sealing, across its entire surface except in the region under the blister. In the preferred embodiment, this base layer comprises a thin foil top layer 120, a plastic film foil-supporting middle layer 122, and a paper bottom layer 124. The thicknesses of layers 120, 122 and 124 have been exaggerated in FIG. 2 for purpose of illustration.

FIGS. 3 and 4 illustrate the method of tear-opening the blister-foil package of the present invention. Since the blister layer is composed a substantially rigid, low extensible-film, the only way that access can be readily gained to the medicament is by grasping the tabs 200 and 202 which are formed on either side of the tear slit and pulling them generally in opposing perpendicular directions with respect to the plane of the package. Due to the strength, rigidity, and offset orientation of the blister, opening of the package by attempting to separate tabs 200 and 202 within the plane of the packages i.e., in the direction of arrows B in FIG. 3, is difficult if not virtually impossible. Thus, the method of opening the package of the present invention differs sharply from those methods which are employed in opening flexible pouch packaging, such as the flexible pouches illustrated in U.S. Pat. No. 3,809,220 (Arcudi) wherein lateral separation is the normal, if not the only feasible method of opening the subject package.

As seen in FIG. 4, upon opening of the package a tear line is caused to propagate first to the end of the blister, and then generally around and along one side of the blister to its remote end. Accordingly, in order to gain ready access to the medicament, it is necessary to tear through at least 75%, preferably about 85% of the length of the rectangle, and in so doing expose a longitudinal edge of the oblong medicament 10 disposed in the package. Even after tearing has been completed the medicament normally remains loosely gripped in one of the ruptured blister portions, from which it may be readily removed, even by an arthritic or infirm patient.

Figure 6:
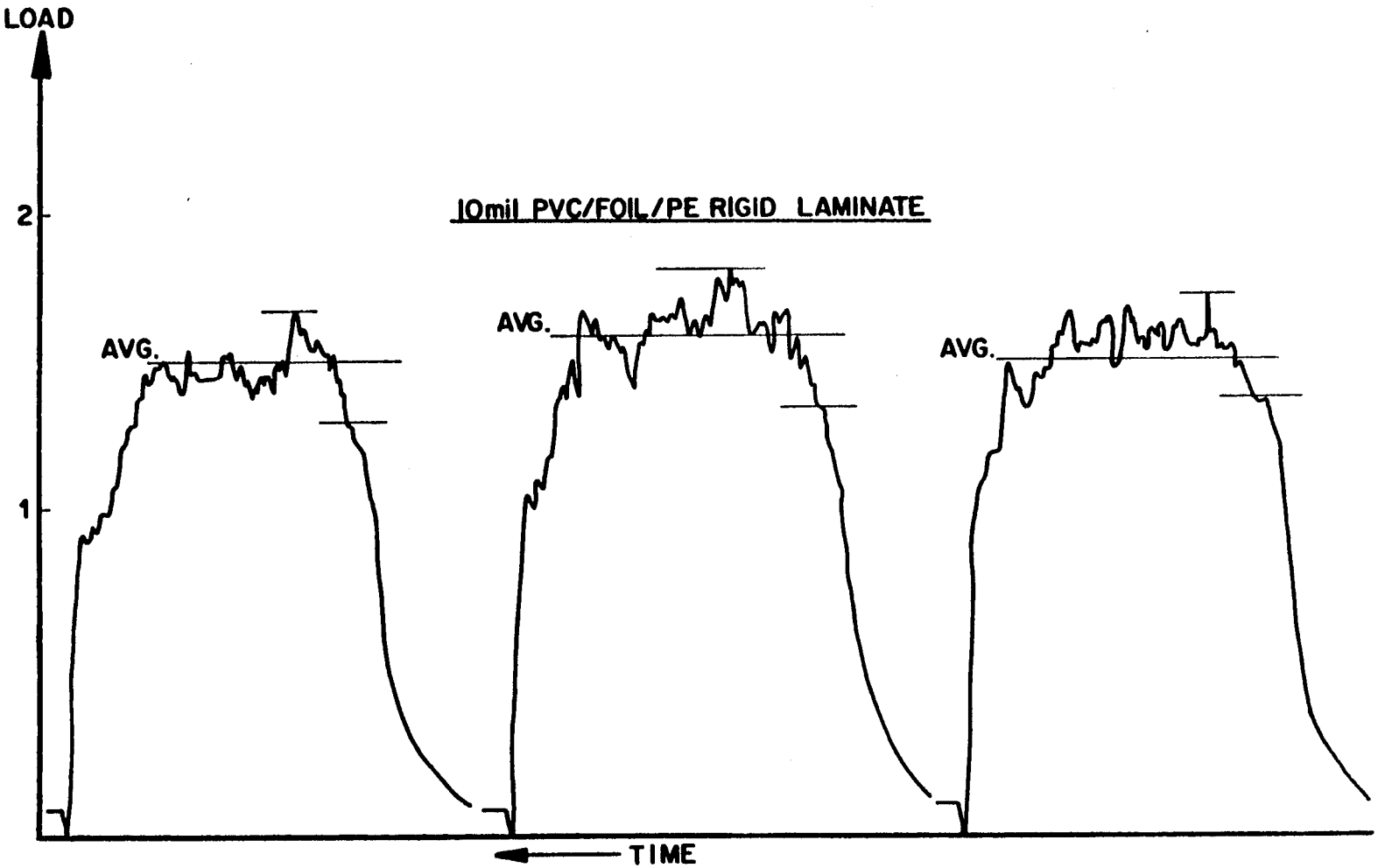
FIG. 6 is a load versus time graph similar to FIG. 5, but for a 10 mil (0.250 mm) PVC/foil/PE laminate useful for making alternate embodiment, bite-through resistant packages of the present invention.

The nature of the tearing characteristics of the package of the present invention is further illustrated in FIGS. 5 and 6. These figures illustrate tear propagation results using the American Society of Testing Materials test D1938-67 (reapproved 1978). Generally, this method determines the force in grams, ounces or pounds needed to propagate a tear across a film or sheeting specimen when measured using a constant-rate-of-grip separation machine as described in method A of ASTM Methods D882. The force in grams, ounces or pounds necessary to propagate the tear is interpreted from load-time charts such as those of FIGS. 5–7. The significance of this method is in rating the tear propagation force of various plastic films and thin sheeting of comparable thicknesses. The tear propagation resistance of highly extensible film or sheeting is distinguished from the tear propagation resistance in little or non-extensible film or sheeting using this method.

In accordance with the preferred embodiment package of the present invention, the blister-foil layer is a 5 mil, preferably a 7.5 to 12 mil (0.200–0.300 mm) rigid, unplasticized PVC sheet. The base layer is 1 mil foil with a 25 pound pouch/48 gauge polyester backing clad with a paper bottom layer. Accordingly, FIG. 5 illustrates three separate tests of tear propagation resistance for 7.5 mil (O.200 mm) rigid PVC/foil/polyester laminate, of the type described above. FIG. 6 is a similar load versus time tear propagation resistance graph for three tests, wherein the laminate comprises a 10 mil (0.25 mm) rigid PVC and the same foil/polyester base layer described above. The laminate bond strength for the laminate illustrated in FIG. 5 was 4.0 pounds per inch, whereas the laminate bond strength of the laminate tested in FIG. 6 was 3.8 pounds per inch. As seen in both FIGS. 5 and 6 the tear propagation resistances o each of these laminates are substantially constant throughout the tear. As seen in FIG. 5, the sample comprising the 7.5 mil PVC film had an average tear propagation resistance for the three samples of approximately 1.13 pounds per inch, with average tear propagation resistances for each of the three samples being about 1.05, 1.10 and 1.25 pounds per square inch respectively. As seen from FIG. 6, the average tear propagation resistance for the three samples graphed in that figure was about 1.52 pounds per square inch, with the individual samples having average tear propagation resistances of 1.50, 1.55 and 1.52 respectively. It should be noted that the tear propagation resistances of each of the laminates tested in FIGS. 5 and 6 are remarkably uniform throughout the tear, always substantially exceeding one pound per inch and never substantially exceeding 1.75 pounds per inch.

Figure 7:
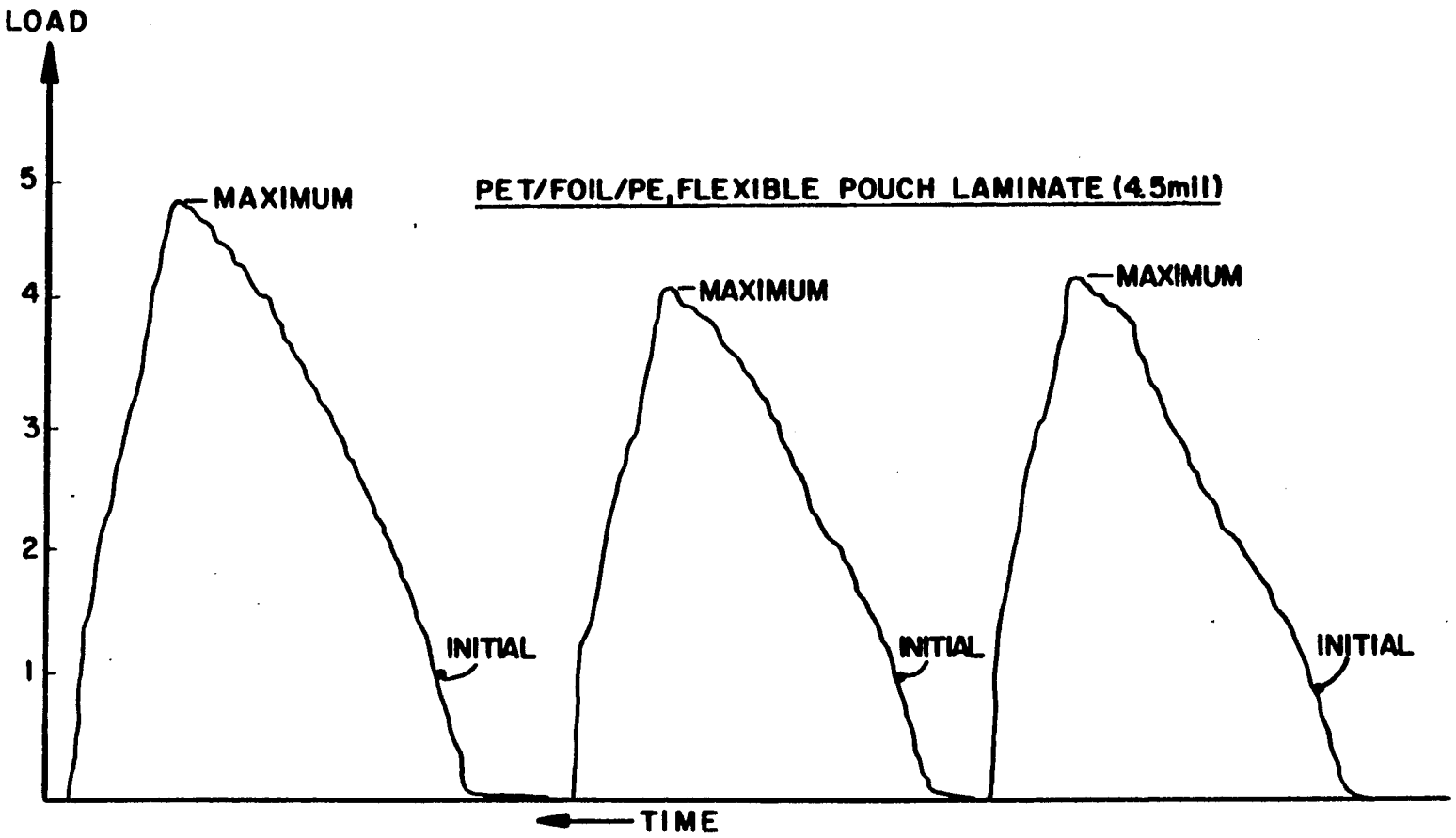
FIG. 7 is a load versus time graph similar to FIGS. 5 and 6, but for a polyethylene terephthalate/foil/-polyethylene (4.3 mil) pouch packaging laminate, showing the tear propagation resistance of a flexible material which as been used in conventional prior art tear-open pouch packages.

The above results were compared to results obtained for a film laminate of a typical flexible pouch package. FIG. 7 reports a test on a polyethylene terephthalate (PET)/foil/polyethylene (PE) pouch material having a thickness of only 4.3 mils. As seen in FIG. 7, the initial tear propagation resistance of the samples in these tests averaged 0.9 pounds per inch. These samples exhibited initial values of 0.8, 0.9, and 1.0 pounds per inch, averaged a maximum for the three samples of 4.37 pounds per inch, and exhibited individual maximums of 4.2, 4.1 and 4.8 pounds per inch respectively. Thus, as seen from FIGS. 5–7, flexible pouch-packaging materials exhibiting high extensibilities have tear propagation resistances which are not advantageous for use in the tear-opening packages of the present application. Using such materials, acceptably high initial tear propagation resistances will inevitably be accompanied by unacceptably higher values near the end of the tear. Accordingly, if efforts are made to compensate for these varying tear propagation characteristics, tear-opening packages of flexible, highly-extensible materials may permit children to gain some access to the harmful contents of a package, while at the same time presenting resistances near the end of the tear-opening process which make medicament access by arthritic or infirm patients particularly difficult.

Accordingly, the preferred blister-foil package of the present invention is designed to exhibit a tear propagation resistance which is substantially continuous during the opening of the package. As seen from FIGS. 5 and 6, the preferred blister-foil package of the present invention comprises a blister layer composed of low extensible film. As used herein a "low extensible film" is a film having tear propagation resistance characteristics similar to those illustrated in FIGS. 5 and 6 wherein the established tear propagation resistance (expressed in pounds per inch) varies by 25% or less. By contrast, a film of high extensibility is a film, such as that illustrated in FIG. 7, where the initial and final tear propagation resistances vary by more than 100%, preferably more than 400%. In particular, the package of the present inventions exhibits a tear propagation resistance of between 1 and 2 pounds per inch during the tear, preferably ranging between about 1 and 1.7 pounds per inch during the tear.

In view of the foregoing description, those of ordinary skill in this art will recognize that various materials may be substituted for those described above. For example, while the preferred rigid PVC mentioned above is a rigid unplasticized PVC sold under the trade designation T36.0 by ICI Americas Inc. of Wilmington Delaware, those of ordinary skill in the art will recognize that there are other suitable unplasticized PVC films, including PVC copolymers such as vinylchloride/vinylacetate copolymers (with or without small amounts interpolymerized acids present), as well as modified PVC and/or laminated PVC materials (which may exhibit somewhat better moisture resistance than conventional PVC). One such preferred modified material, for example, is a 7.5 mil PVC which is laminated with 2 mil polyethylene and 1.5 mil Aclar 22A coatings. PVC may also be sprayed or laminated with a polyvinylidene chloride coating, also to improve its moisture resistance characteristics. Those of ordinary skill in the art will further recognize that the preferred rigid substantially rectangular blister layer of the described package should be composed of a thermoformable material, such that blisters can be made using either male or female molds to form the desired oblong blisters. As such, the films of the blister layer are quite different from polyester films, such as those sold under the trademarks Mylar or Melanex, which are not generally thermoformable except perhaps in specialty applications or with special formulations.

Those of ordinary skill in the art will also recognize that various foil backings can be used in the construction of the herein-described package. The polyester supported foil mentioned above is a Reynolds 201 foil supported with a thin polyester (Mylar) middle layer, which may optionally be backed by a paper, such as a 15 pound paper. To accomplish the heat sealing of the foil to the blister layer, the foil may be coated with a heat seal coating, such as vinyl.

Tests of the packages of the present invention using 7.5 mil and 10 mil blister layers have shown that these packages exhibit suitable child resistance. When protection against bite through of the package is desired, the use of a 10 mil blister layer is preferred.

As seen from the above, the present invention provides a simple, easily fabricated tear-opening blister-foil package exhibiting substantial advantages over those heretofore known to the art. These packages are difficult for a child to access, but may be readily opened by arthritic or infirm patients, who will find the retention of the medicament within a portion of the torn blister to be a substantial advantage.

What is claimed is:

1. A combination of a chile-resistant blister-foil package and a medicament packaged therein, comprising:

(a) a base layer; and a rigid substantially rectangular blister layer composed of low extensible film joined to said base layer, said blister layer having an oblong longitudinally oriented blister formed at one end thereof which contains said medicament and a tear slit directed at one end of the blister, said tear slit being disposed through the other end of said blister layer; said slit and said blister defining tear tabs which allow the package to be torn open through the entire length of said blister, said base and blister layers being joined such the opening of the package requires tearing through the blister formed on the blister layer.

2. The chile-resistant blister-foil package of claim 1 wherein said package exhibits a tear propagation resistance which is substantially continuous during the opening of said package.

3. The chile-resistant blister-foil package of claim 1 wherein said film has a thickness of at least 5 mil.

4. The package of claim 1 wherein said package exhibits a tear propagation resistance of between 1 and 2 pounds per inch during said tear.

5. The package of claim 1 wherein said package exhibits a tear propagation resistance of between about 1 and 1.75 pounds per inch during said tear.

6. The package of claim 1 wherein said film has a thickness of at least about 7.5 mil.

7. The package of claim 6 wherein said film has a thickness of about 10 mil.

8. The package of claim 6 wherein said film is a rigid PVC film.

9. The package of claim 1 wherein said blister is thermoformed in said film.

10. The package of claim 1 wherein said base layer comprises a paper backed foil.

11. The package of claim 1 wherein said base layer is heat sealed to said blister layer except in the region of said blister.

12. A combination of a child-resistant blister foil package and a medicament packaged therein, comprising:

(a) a base layer; and (b) a rigid blister layer joined to said base layer, said blister layer having a blister formed therein which contains said medicament, and a tear slit disposed through said package directed at one end of said blister, said base and blister layers being joined such that opening of the package requires tearing through said blister formed in said blister layer.

13. A combination of a child-resistant blister-foil package and a medicament packaged therein comprising:

(a) a base layer; and (b) a rigid blister layer joined to said base layer, said blister layer having a blister formed at one end thereof which contains said medicament and a tear slit disposed through the opposite end of said blister layer, said base and blister layers being joined such that opening of the package requires tearing through said blister formed in said blister layer.

* * * * *

UNITED STATES PATENT AND TRADEMARK OFFICE

CERTIFICATE OF CORRECTION

PATENT NO. : 5,088,603

DATED : February 18, 1992

INVENTOR(S) : Jack H. Kirkpatrick

It is certified that error appears in the above-identified patent and that said Letters Patent is hereby corrected as shown below:

On the title page: Item [56] Reference Cited:

Column 1, line 35, please delete "Swezay" and insert therefor --Swezey--.

Column 2, line 3, please delete "206/78" and insert therefor --206/75--.

Column 1, line 58, please delete "2,796,9S2" and insert therefor --2,796,982--.

Column 1, line 58, please delete "2,35S,246" and insert therefor --2,358,246--.

Column 1, line 62, please delete "(Hutchenson)" and insert therefor --(Hutcheson)--.

Column 3, line 33, please delete "infirm and users" and insert therefor --infirm end users--.

Column 3, line 60, please insert --(-- before "0.200 mm)".

Column 4, line 30, please delete "½ ¾" and insert therefor --½ to ¾--.

Column 5, line 3, please insert --of-- after "composed".

Column 5, line 11, please delete "packages" and insert therefor --package--.

UNITED STATES PATENT AND TRADEMARK OFFICE

CERTIFICATE OF CORRECTION

PATENT NO. : 5,088,603

DATED : February 18, 1992

INVENTOR(S) : Jack H. Kirkpatrick

It is certified that error appears in the above-identified patent and that said Letters Patent is hereby corrected as shown below:

Column 7, line 46, please delete "chile-resistant" and insert therefor --child-resistant--.

Column 8 line 6, please delete "chile-resistant" and insert therefor --child-resistant--.

Column 8, line 10, please delete "chile-resistant" and insert therefor --child-resistant--.

Signed and Sealed this

Fourteenth Day of September, 1993

Bruce Lehman

*Attest:*

BRUCE LEHMAN

*Attesting Officer*

*Commissioner of Patents and Trademarks*